US008356720B2

(12) United States Patent
Mathews

(10) Patent No.: US 8,356,720 B2
(45) Date of Patent: Jan. 22, 2013

(54) CONTAINER STORAGE SYSTEM

(75) Inventor: Carl L. Mathews, Riverview, FL (US)

(73) Assignee: Container, Bracket & Shelving, LLC, Riverview, FL (US)

( * ) Notice: Subject to any disclaimer, the term of this patent is extended or adjusted under 35 U.S.C. 154(b) by 0 days.

(21) Appl. No.: 13/285,532

(22) Filed: Oct. 31, 2011

(65) Prior Publication Data

US 2012/0111816 A1 May 10, 2012

Related U.S. Application Data

(60) Provisional application No. 61/410,842, filed on Nov. 5, 2010.

(51) Int. Cl.
*A47F 5/08* (2006.01)

(52) U.S. Cl. ..... 211/90.02; 211/113; 108/149

(58) Field of Classification Search ..... 108/149, 108/152, 182; 248/235, 250, 323, 329, 332; 211/90.01, 90.04, 90.02, 87.01, 88.01, 88.03, 211/113, 117, 119.004, 119.009, 209, 180, 211/193; 224/543, 572; 403/290, 408.1
See application file for complete search history.

(56) References Cited

U.S. PATENT DOCUMENTS

| | | | | | |
|---|---|---|---|---|---|
| 3,465,893 | A * | 9/1969 | Kinney | 211/86.01 |
| 4,061,092 | A * | 12/1977 | Jacobsen et al. | 108/149 |
| 4,125,302 | A * | 11/1978 | Peritz et al. | 312/242 |
| 4,167,908 | A * | 9/1979 | Jones et al. | 108/182 |
| 4,244,301 | A * | 1/1981 | Nakatsu | 108/149 |
| 4,388,982 | A * | 6/1983 | Yonahara | 182/82 |
| 4,502,619 | A * | 3/1985 | Cox | 224/311 |
| 4,589,351 | A * | 5/1986 | Love | 108/164 |
| 4,685,575 | A * | 8/1987 | Kulbersh | 211/90.02 |
| 5,052,648 | A * | 10/1991 | Landau | 248/235 |
| 5,749,183 | A * | 5/1998 | Wright | 52/201 |
| 6,021,908 | A * | 2/2000 | Mathews | 211/90.02 |
| 6,024,230 | A * | 2/2000 | Menaged et al. | 211/87.01 |
| 6,116,164 | A * | 9/2000 | Justen, Jr. | 108/42 |
| 6,224,029 | B1 * | 5/2001 | Marble et al. | 248/214 |
| 6,684,812 | B1 * | 2/2004 | Tucker | 119/57.91 |
| 7,651,065 | B2 * | 1/2010 | Sloan | 248/339 |
| 2008/0011920 | A1 * | 1/2008 | Sloan | 248/235 |
| 2011/0062301 | A1 * | 3/2011 | Sloan | 248/304 |

* cited by examiner

*Primary Examiner* — Jennifer E Novosad
*Assistant Examiner* — Hiwot Tefera
(74) *Attorney, Agent, or Firm* — Gray Robinson, P.A.

(57) ABSTRACT

A container shelving system including two shelf support members and a plurality of shelves, the shelf support members including a chain, a turnbuckle, an adjustable upper bracket and an adjustable lower bracket, each bracket including a first box beam, a second box beam, and a box beam adjustment fastener, the box beams including recesses at each end, the recesses configured to receive the chain; the upper bracket further including a stabilizer perpendicularly connected to an end of the upper bracket; the plurality of shelves each including a plurality of lumber whereby the lumber is configured to sit upon a bracket; whereby the chain is threaded through the first and second cargo rings and the upper and lower brackets and connected and tightened using the turnbuckle such that the shelves may be supported upon the brackets within the shipping container.

1 Claim, 7 Drawing Sheets

CONTAINER STORAGE SYSTEM

CROSS-REFERENCE TO RELATED INVENTIONS

This application claims the benefit of provisional application No. 61/410,842, filed Nov. 5, 2010, the entire contents of which are incorporated by reference herein.

BACKGROUND OF THE INVENTION

1. Field of the Invention

The present disclosure relates generally to brackets for shelving systems and containers and more particularly, to brackets applicable for use in connection with a variety of systems including chain and cable shelving systems and stationary and shipping container systems.

Existing brackets for shelving systems and containers are typically comprised of a variety of components including assemblies utilizing straps, cables, rod, couplers, suspended shelves, uprights, hooks and webbing.

2. Description of the Background Art

Adding shelving support to shipping containers is not new. U.S. Pat. No. 7,651,065 to Sloan discloses a storage system for sea-land shipping containers. The system disclosed therein includes an elongated hanging beam which is hooked onto a shipping container.

The aforementioned shelving systems are often unreliable for their intended field of use. The weight of the systems in conjunction with the items shelved thereon affects the performance and reliability of the systems. Additionally, the weight and size of the systems hinders the transportation of the systems to installers.

In spite of the advancements in the use of modern, more lightweight materials for industrial applications, there has been little improvement in the overall technology and implementation in the shelving system field.

Accordingly, there exists a need in the industry to overcome these problems and provide a shelving system which is sturdy enough to support sufficient load, while still being portable and easy to package and deliver to locations.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

A preferred embodiment of the present disclosure provides for utilization of brackets for shelving systems and containers of various designs for a variety of applications. This disclosure will include embodiments which can benefit from the invention.

In one aspect of the present disclosure, shelves are supported within a container by way of two support members where each support member comprises two or more brackets, a connector and a turnbuckle. In one aspect, the connector is a chain. In another aspect, the connector is a cable.

An advantage of the present disclosure is the ability to install shelving in a shipping container, or any other wall surface with a hooking mechanism at the top and bottom using a portable system.

Another advantage of the present disclosure is the ease with which shelving can be installed in a container in accordance with the present teachings.

Various embodiments of the disclosure may have none, some, or all of these advantages. Other technical advantages of the present disclosure will be readily apparent to one skilled in the art.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present disclosure and its advantages, reference is now made to the following descriptions, taken in conjunction with the accompanying drawings, in which.

Similar reference characters refer to similar parts throughout the several views of the drawings.

DETAILED DESCRIPTION OF THE PREFERRED EMBODIMENT

The present disclosure relates to a wall shelving system. In a preferred embodiment, the wall shelving system is utilized in a container, such as a shipping container. Alternatively, the shelving system may also be applied against any other wall with appropriate connecting mechanisms. Additionally, the shelving system may also be used against a post or other support mechanism that has the ability to interconnect with the system discussed below.

Figure 1:
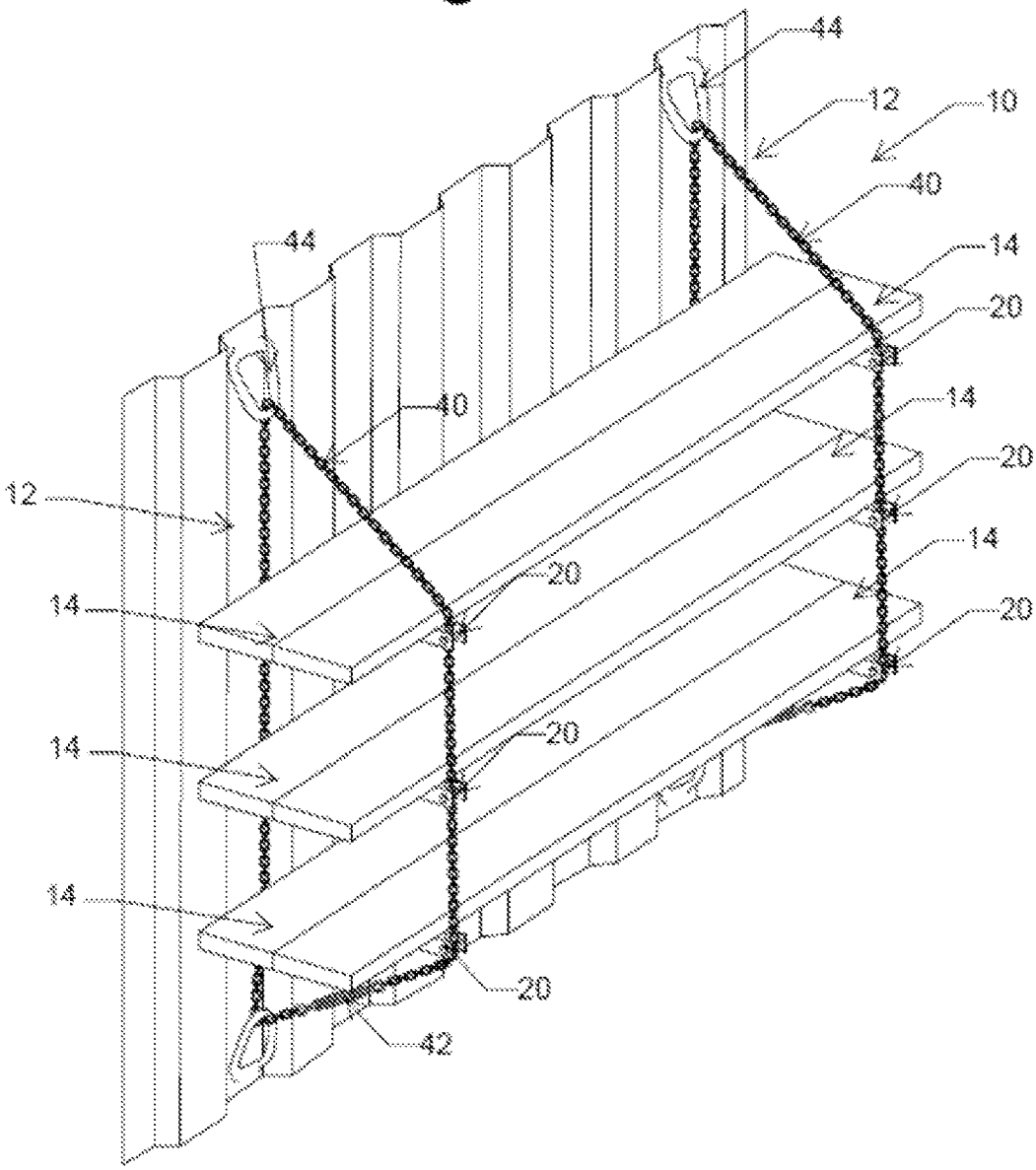
FIG. 1 is an isometric view of a system in accordance with the present disclosure.

As shown in FIG. 1, the wall shelving system 10 is comprised of two shelf support members 12 and one or more shelves 14 supported by the shelf support members 12. In a preferred embodiment, the shelves 14 may be standard lumber sufficient to support whatever is to be placed on the shelf.

Figure 2:
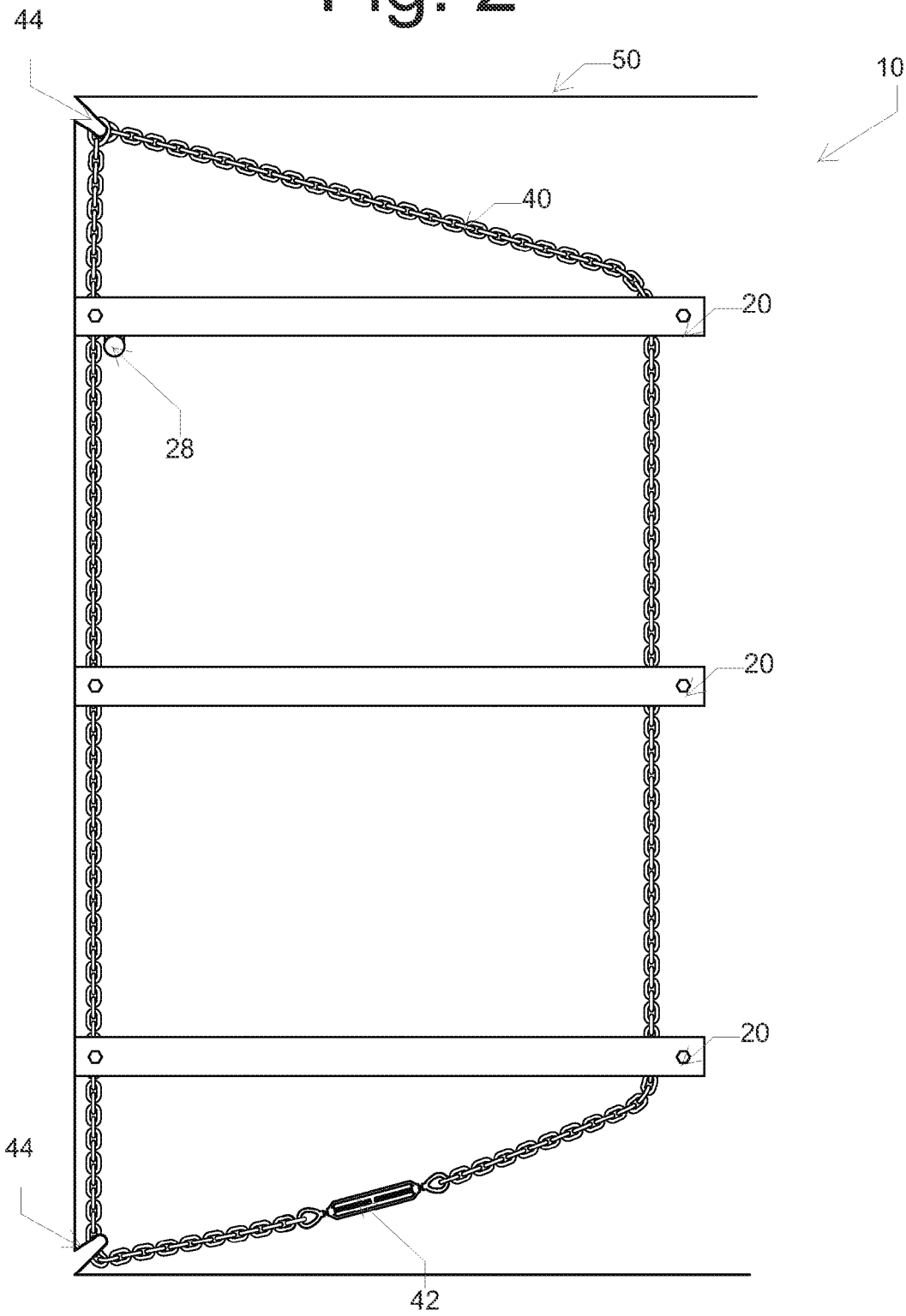
FIG. 2 is a side view of a supporting member in accordance with the present disclosure.
Figure 3:
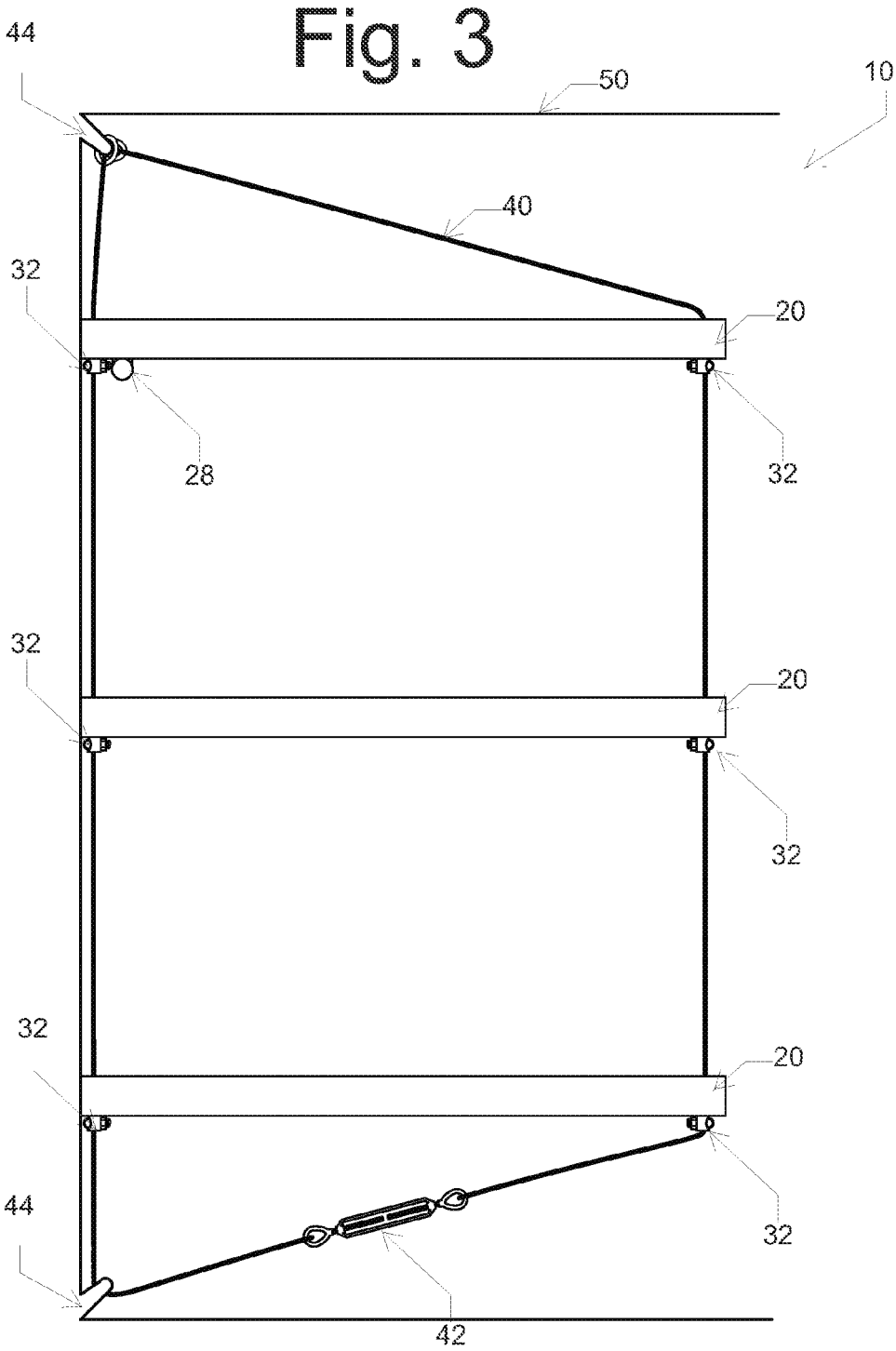
FIG. 3 is a side view of an alternative embodiment of a supporting member in accordance with the present disclosure.

FIGS. 2 and 3 provide more detail for the shelf support members 12. Each shelf support member comprises one or more brackets 20 which are interconnected and supported via a connector 40. FIG. 3 depicts the connector 40 as a cable, while FIG. 2 depicts the connector 40 as a chain. Any suitable material which could be threaded through or attached to the brackets 20 and cargo rings 44 (as discussed below) which would have suitable strength characteristics to support the load on the shelves 14 would suffice. Alternatively connector 40 may be attached to cargo rings 44 with 1 or 2 clevises or similar attachments.

In a preferred embodiment, the shelving system 10 of the present disclosure is installed in a container 50, such as a shipping container. These containers 50 have cargo rings 44 typically located at the top and bottom of a wall. Any wall surface with a hooking mechanism at the top and bottom would be suitable for installation of the shelving system 10 disclosed herein.

As shown in FIGS. 2 and 3, the connector 40 is connected to the top cargo ring 44 with a shackle or other secure means to prevent rotation while still being strong enough to carry the intended load. Connector 40 can then be threaded or attached to bottom cargo ring 44. Two connector 40 ends can then be joined using a turnbuckle 42 or any other coupler. The turnbuckle 42 eases installation of the shelving system 10 because the connector 40 can be connected through the brackets (discussed below) and the cargo rings 44, leaving slack in the connector 40. Once the connection is in place, an operator can affix the turnbuckle 42 and tighten the connector an appropriate amount to provide adequate support.

Figure 11:
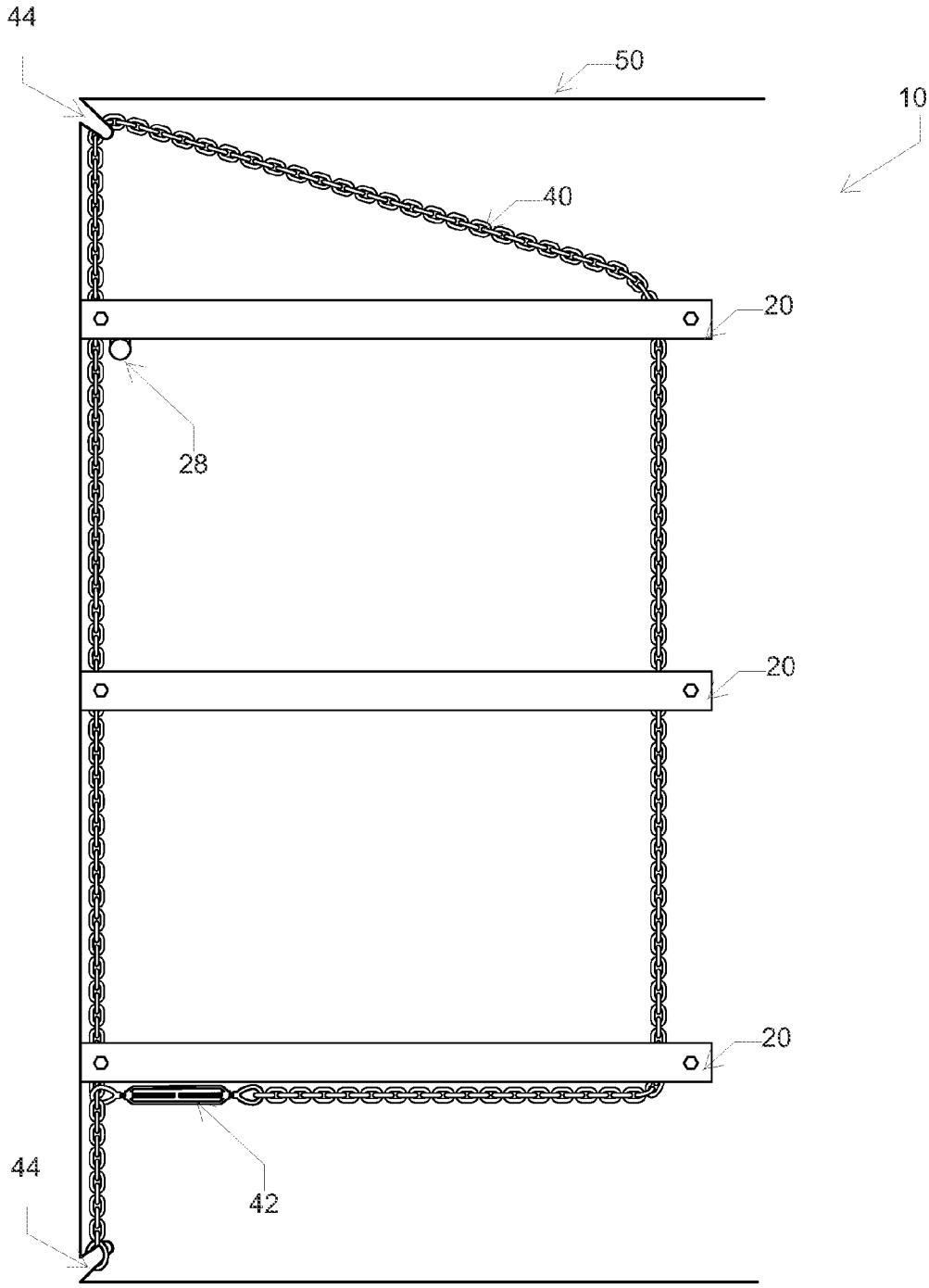
FIG. 11 is a side view of a supporting member in accordance with another embodiment of the present disclosure.

In the case of a chain connector 40 (as shown in FIG. 2), a single chain connector or two connectors 40 may be used. When using a cable connector 40 (as shown in FIG. 3), a single connector 40 can be used (not depicted), or two connectors 40 may be used. Per FIG. 3, a first connector 40 is attached to the top cargo ring 44. In a preferred embodiment, the cable connector 40 includes an eyelet in one end and a clevis is used to connect the eyelet in the cable connector 40 to the cargo ring 44. This first cable connector 40 can be run parallel down the wall of the container 50 and looped through the bottom cargo ring 44. A second cable connector 40 could then be connected to the top cargo ring 44 on one end, and connected (by way of the turnbuckle 42) to the first cable connector 40. The turnbuckle 42 may be connected in any number of manners, as shown for example in FIGS. 2, 3, and 11. For instance, the turnbuckle 42 may be connected directly underneath the bottom bracket 20 as shown in FIG. 11. This may have the added advantage of freeing up additional storage space underneath the shelving system 10 without interference from the connector 40.

Figure 4:
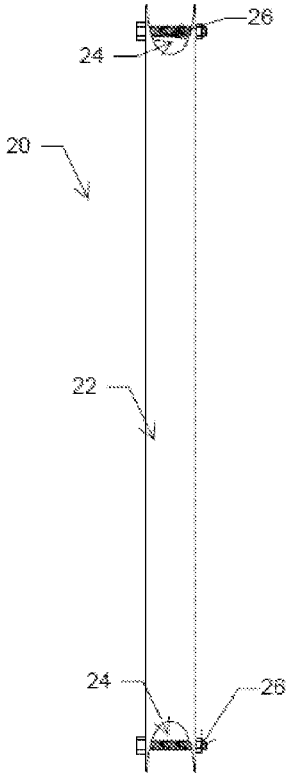
FIG. 4 is a top view of a bracket for use in a supporting member in accordance with the present disclosure.

FIG. 4 shows a bracket 20 in accordance with the present disclosure. The bracket 20 may be used with either a chain connector 40 or cable connector 40 (as discussed further below). The bracket 20 is preferably a box beam 22 configuration and includes two recesses 26 at each end. Alternatively, the bracket 20 may be a U-channel configuration (not depicted). The bracket 20 may be made from tubular steel (or any other suitable material) in a box beam or U-channel form. The box beam (as shown in more detail in FIGS. 5*a* and 7*a*) can be any suitable dimensions, with a preferred height and width of 1.25"×1.25" or whatever size needed to withstand the intended load.

Figure 5:
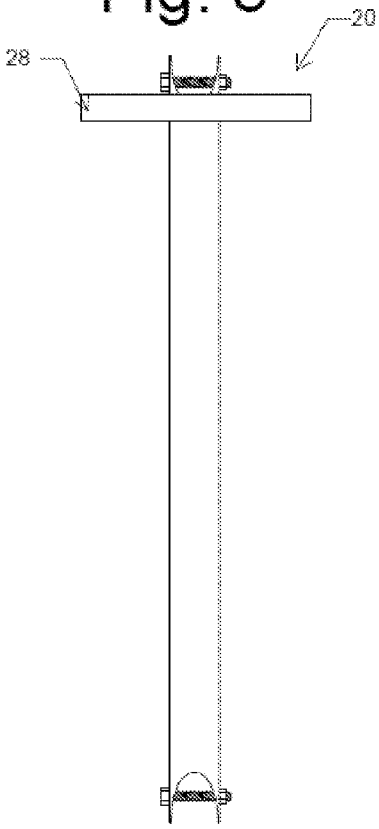
FIG. 5 is a bottom view of a top bracket for use in a supporting member in accordance with the present disclosure.
Figure 5A:
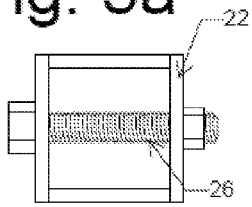
FIG. 5*a* is a front view of a bracket for use in a supporting member in accordance with the present disclosure.

The recesses 24 at each end may be cut out of the steel (or formed in any other suitable manner) with such dimensions that the connector 40 can be connected to the bracket 20 to support the bracket 20 in the system 10 disclosed herein. In the case of a chain connector 40, the brackets 20 depicted in FIGS. 4 and 5 are a preferred embodiment. A fastener 26 (for instance, a bolt, a screw or the like) can be connected to the bracket 20 at the point of the recesses 24. Thus, when a chain connector 40 is placed within the recess 24 a fastener 26 can be run through a link in the chain connector 40 connecting the bracket 20 to the chain. This enables an operator to thread the chain connector 40 to the container 50 first and then install brackets at whatever desired height is needed. The chain connector 40 is connected to the distal and proximal ends of the bracket 20. The tension in the chain connector 40 (caused by tightening the turnbuckle 42) provides the support needed to hold the shelving system 10.

FIG. 5 depicts an alternate bracket 20. This bracket 20 includes an additional stabilizer 28 which is affixed perpendicularly to the lengthwise box beam (or U-channel) member 22. Preferably, the stabilizer 28 is welded to the lengthwise member 22. In a preferred installation, a bracket 20 including a stabilizer is installed as the uppermost shelf support, while brackets 20 without the stabilizer (per FIG. 4) are used for the lower shelves. The use of a stabilizer 28 in the uppermost bracket 20 combined with proper tension in the connector 40 provides a suitably secure support structure for the shelves 14.

Figure 6:
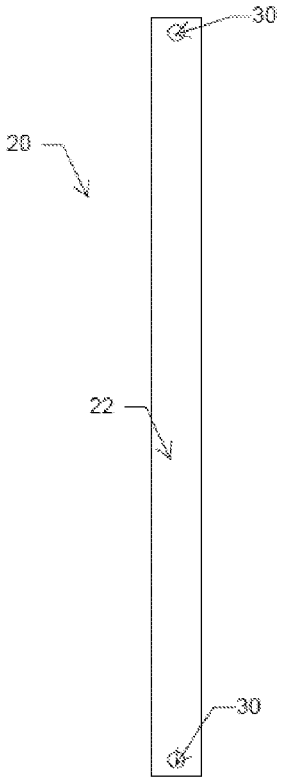
FIG. 6 is a top view of an alternative embodiment of a bracket for use in a supporting member in accordance with the present disclosure.
Figure 7:
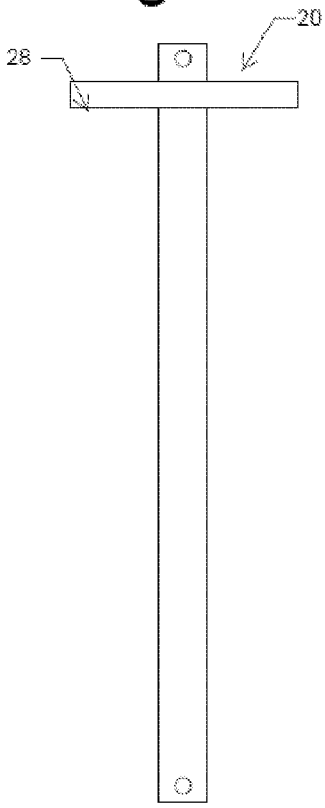
FIG. 7 is a bottom view of an alternative embodiment of a top bracket for use in a supporting member in accordance with the present disclosure.
Figure 7A:
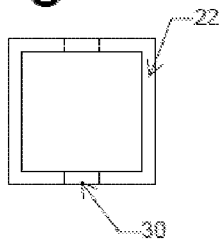
FIG. 7*a* is a front view of an alternative embodiment of a bracket for use in a supporting member in accordance with the present disclosure.
Figure 9:
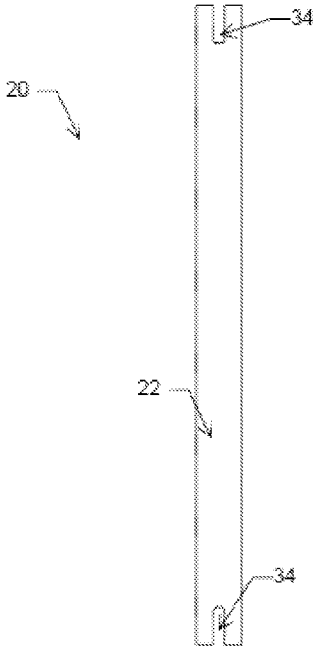
FIG. 9 is a top view of an alternative embodiment of a bracket for use in a supporting member in accordance with the present disclosure.
Figure 10:
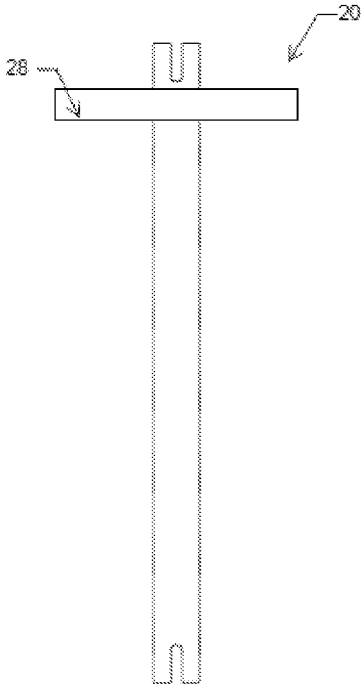
FIG. 10 is a bottom view of an alternative embodiment of a top bracket for use in a supporting member in accordance with the present disclosure.

FIGS. 6 and 7 depict an alternate embodiment for brackets 20 in accordance with the present disclosure. The brackets 20 depicted in FIGS. 6 and 7 are for use with a cable connector 40. Each bracket has a cable opening at the distal and proximal ends so that a cable connector 40 may be threaded through, or slid into a slot (as shown in FIGS. 9 and 10) to attach the bracket 20 to the cable connector. In order to provide vertical support (so the bracket does not slide down the cable connector 40), a clamp 32 (or any other similar mechanism) is preferably affixed to the cable connector immediately below the desired height of the respective bracket 20. See FIG. 3. Additional clamps 32 may also be used, for instance above the bracket 20 (not depicted).

Figure 8:
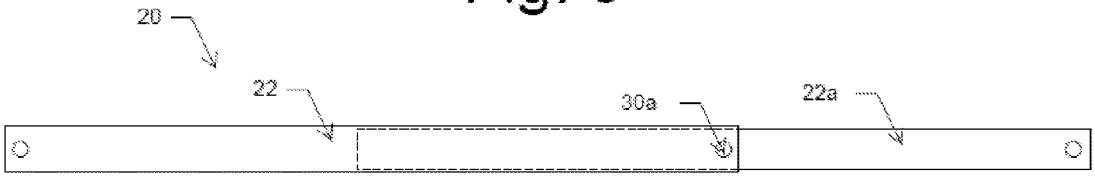
FIG. 8 is a side view of an extension bracket for use in a supporting member in accordance with the present disclosure.

FIG. 8 shows an alternate embodiment of the present disclosure whereby the bracket 20 lengths can be adjusted. Using such brackets 20, an operator can control the amount of shelf space to provide within the container 50. In such a configuration, the bracket 20 includes a first lengthwise member 22 and a second lengthwise member 22*a*. The second lengthwise member 22*a* is also a box beam shape (or U-channel), but is dimensioned so that it can slide into the first lengthwise member 22. The second lengthwise member 22*a* can be fixed in place within the larger first lengthwise member 22 by means of a fastener through an opening 30*a*. Putting a fastener through opening 30*a* is not required though, as once the system 10 is installed, the placement of the shelves 14 on top of the brackets 20 will ensure that the brackets 20 do not compress.

Brackets 20 in the shape of FIGS. 4 and 5 may also be used with a cable connector 40. This provides one of the same advantages as above, namely an operator can install the cabling and then affix the brackets 20 afterwards at whatever desired height. To do so, the cable connector 40 is installed, then an operator slides a bracket 20 over the cable connector 40 such that the cable connector sits within the recess 24. The operator then installs a fastener 26 behind the cable connector 40 such that the cable connector 40 is bound between the apex of the recess 24 and the fastener 26. This connects the bracket 20 to the cable connector 40. Finally, the operator installs a clamp 32 directly underneath the bracket so as to hold the bracket in place. Additional clamps 32 may also be used, for instance above the bracket 20 (not depicted).

In another embodiment, brackets 20 in the configuration of FIGS. 9 and 10 may be used with a cable connector 40. These brackets 20 include a slot 34 which may be used to slide the bracket 20 onto the cable connector 40. Again, a clamp 32 may be placed underneath the bracket 20 to provide additional support. Additional clamps 32 may also be used, for instance above the bracket 20 (not depicted).

In an alternate embodiment (not depicted), a second turnbuckle 42 may be used so that the connector 40 may be tucked under the bottom shelf 14 and connected back to the connector 40. The first turnbuckle 42 in this embodiment would be used to connect the connector 40 to the bottom cargo ring 44. In this manner, the space under the bottom shelf 14 may be utilized without needing to work around the connector 40.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

Now that the invention has been described,

What is claimed is:

1. A container shelving system for providing shelves in a shipping container whereby the shipping container includes a first cargo ring and a second cargo ring, the shelving system comprising:

two shelf support members and a plurality of shelves, the shelf support members comprising a chain including a plurality of links, a turnbuckle, an independent adjustable upper bracket and an independent adjustable lower bracket, each bracket comprising a first box beam, a second box beam, and a box beam adjustment fastener, the first box beam and the second box beam each in a rectangular shape, the box beams including recesses at each end, the recesses configured as opened notches and arranged to receive one of the links of the chain, the box beam further including openings perpendicular to the recesses, the openings configured to receive a fastener such that the fastener holds the bracket in place in relation to the chain when the chain is received within the recess;

whereby the second box beam is configured to slide partially within the first box beam and is secured thereto using the box beam adjustment fastener;

the upper bracket further comprising a stabilizer perpendicularly connected to an end of the upper bracket;

the plurality of shelves each comprising a plurality of lumber whereby the lumber is configured to sit upon a bracket;

whereby the chain is threaded through the first and second cargo rings and the upper and lower brackets and connected and tightened using the turnbuckle such that the shelves may be supported upon the brackets within the shipping container.

* * * * *